US009470003B1

(12) United States Patent
Moon

(10) Patent No.: US 9,470,003 B1
(45) Date of Patent: Oct. 18, 2016

(54) METHODS AND APPARATUSES FOR ALIGNING TILES

(71) Applicant: Garry Ernest Moon, Grande Prairie (CA)

(72) Inventor: Garry Ernest Moon, Grande Prairie (CA)

( * ) Notice: Subject to any disclaimer, the term of this patent is extended or adjusted under 35 U.S.C. 154(b) by 0 days.

(21) Appl. No.: 14/685,367

(22) Filed: Apr. 13, 2015

(51) Int. Cl.
*E04D 15/00* (2006.01)
*E04F 21/20* (2006.01)

(52) U.S. Cl.
CPC ..... *E04F 21/20* (2013.01)

(58) Field of Classification Search
CPC ..... E04F 21/0092; E04F 13/0892; E04F 21/1877
USPC ..... 52/749.11, 747.11, 126.7, 126.5
See application file for complete search history.

(56) References Cited

U.S. PATENT DOCUMENTS 2,266,892 A * 12/1941 Mullen ..... E04B 1/41 248/216.1
2,938,376 A * 5/1960 Workman ..... E04F 13/0862 52/314
3,503,174 A * 3/1970 Nichols ..... E04G 21/22 52/749.14
3,828,735 A * 8/1974 Graham ..... F23M 5/08 110/336
4,397,125 A * 8/1983 Gussler, Jr. ..... E04F 21/22 52/127.3
4,833,780 A * 5/1989 Pollock ..... B25B 27/0092 294/61
4,875,801 A * 10/1989 Montrym ..... E01C 23/023 404/48
6,394,518 B1 * 5/2002 Kelley ..... B25B 27/0092 294/61
6,604,330 B2 8/2003 Repasky
7,257,926 B1 * 8/2007 Kirby ..... E04F 15/02005 33/526
7,621,100 B2 * 11/2009 Kufner ..... E04F 13/0892 33/526
7,861,487 B2 * 1/2011 Kufner ..... E04F 15/02005 33/526
7,954,300 B1 * 6/2011 Kufner ..... E04F 21/22 33/526
8,429,879 B1 * 4/2013 Hoffman ..... E04F 21/0092 52/747.11
8,607,468 B2 * 12/2013 Hillebrandt ..... E04F 15/02005 33/527

(Continued)

FOREIGN PATENT DOCUMENTS

CN 204174898 U 2/2015
CZ 26728 U1 4/2014

(Continued)

OTHER PUBLICATIONS

"LASH™ Tile Leveling Clips and Wedges 99720/99725," Q.E.P. Co., Inc., Boca Raton, Fla., Information Sheet T059/QPDS0041/5161, <http://www.homedepot.com/catalog/pdfImages/4c/4c7e6ac4-a0c1-4ad1-94d8-1d40ccd64139.pdf> [retrieved Aug. 31, 2015], 1 page.

(Continued)

*Primary Examiner* — Basil Katcheves
*Assistant Examiner* — Joshua Ihezie
(74) *Attorney, Agent, or Firm* — Christensen O'Connor Johnson Kindness PLLC

(57) ABSTRACT

A tile alignment device includes: a shaft having a handle end and a blade end; opposed blades extended laterally from the shaft at the blade end; and a pressure plate mounted on the shaft to define respective tile receiving recesses between the pressure plate and the respective opposed blades. A combination includes: a tile alignment device; adjacent tiles each clamped within a respective one of the tile receiving recesses, in which external faces, of the adjacent tiles, contact the pressure plate and are flush relative to one another. A method includes: inserting a blade end of a shaft into a gap between side walls of adjacent tiles, the blade end having opposed blades extended laterally from the shaft; hooking the opposed blades underneath the adjacent tiles; and clamping the adjacent tiles between the opposed blades and a pressure plate mounted on the shaft.

20 Claims, 2 Drawing Sheets

(56) References Cited

U.S. PATENT DOCUMENTS

| | | | | |
|---|---|---|---|---|
| 8,635,815 | B2 * | 1/2014 | Bordin | E04F 21/0092 33/526 |
| 8,800,246 | B2 | 8/2014 | Gorton | |
| 8,887,475 | B2 * | 11/2014 | Ghelfi | E04F 21/0092 52/749.11 |
| 9,027,308 | B2 * | 5/2015 | Kufner | E04F 21/00 52/126.6 |
| 2006/0185319 | A1 * | 8/2006 | Kufner | E04F 13/0892 52/749.11 |
| 2010/0263304 | A1 * | 10/2010 | Torrents I Comas | E04F 21/0092 52/126.5 |
| 2010/0287868 | A1 * | 11/2010 | Kufner | E04F 15/02005 52/391 |
| 2014/0033640 | A1 * | 2/2014 | Gorton | E04F 21/22 52/747.11 |
| 2014/0325936 | A1 | 11/2014 | Psaila | |

FOREIGN PATENT DOCUMENTS

| | | | |
|---|---|---|---|
| DE | 29810627 | U1 | 11/1998 |
| DE | 102009051393 | B3 | 3/2011 |
| DE | 102010045943 | A1 | 5/2012 |
| JP | 2013-204318 | A | 10/2013 |

OTHER PUBLICATIONS

"LévL™ Tile Levelling: Mandrel," Übertile™, 2014, <http://www.ubertile.com/tools/I%C3%A9vl%E2%84%A2-tile-levelling-mandrel [retrieved Apr. 8, 2015], 1 page.

"Raimondi LS250WEDGE 250-Piece Tile Leveling System Wedges," Raimondi Tools USA, Brookfield, Wisc., <http://www.amazonsupply.com/raimondi-ls250wedge-250-piece-leveling-system/dp/B003PON2E4> [retrieved Apr. 8, 2015], 2 pages.

Semakov, D., "Device for Leveling the Tiles No. 2," <http://tfinb.com/251.htm> [retrieved Apr. 8, 2015], 4 pages.

"Tuscan SeamClip™," Tuscan Leveling System, Fairfield, Iowa, <http://www.tuscanleveling.com/Products/Seamclip/seamclip.html> [retrieved Aug. 31, 2015], 3 pages.

International Search Report and Written Opinion mailed Jun. 9, 2016, issued in corresponding International Application No. PCT/CA2016/050280, filed Mar. 14, 2016, 10 pages.

* cited by examiner

METHODS AND APPARATUSES FOR ALIGNING TILES

TECHNICAL FIELD

This document describes methods and apparatuses for aligning tiles with one another.

BACKGROUND

Tile levelling devices exist for aligning the external faces of adjacent tiles flush with one another during installation. One type of device uses a clip that is embedded in unset mortar below the adjacent tiles, with a frangible stem extending through the tile gap. A ratchet wedge is inserted into an aperture in the stem and positioned across the adjacent tiles until the tiles are gripped between the base and wedge. Another device uses a base that is embedded in unset mortar, and into which a stem is threaded until a disc connected to the stem clamps the tiles between the base and disc. In both cases after the mortar sets the stem is removed or severed from the base, leaving the base permanently embedded within the mortar.

SUMMARY

A tile alignment device is disclosed comprising: a shaft having a handle end and a blade end; opposed blades extended laterally from the shaft at the blade end; and a pressure plate mounted on the shaft to define respective tile receiving recesses between the pressure plate and the respective opposed blades.

A combination is disclosed comprising: a tile alignment device; adjacent tiles each clamped within a respective one of the tile receiving recesses, in which external faces, of the adjacent tiles, contact the pressure plate and are flush relative to one another.

A method is disclosed comprising: inserting a blade end of a shaft into a gap between side walls of adjacent tiles, the blade end having opposed blades extended laterally from the shaft; hooking the opposed blades underneath the adjacent tiles; and clamping the adjacent tiles between the opposed blades and a pressure plate mounted on the shaft.

A tile levelling device is disclosed comprising a shaft having a handle end and a blade end, opposed blades extending laterally from the shaft at the blade end, and a pressure plate spring mounted on the shaft to define respective bights between the pressure plate and the respective blades for receiving adjacent respective tiles. A tile face alignment device is disclosed comprising: a shaft; first and second prongs laterally extended from opposite sides of a base of the shaft; a pad mounting a portion of the shaft for relative axial movement within a passage through the pad, in which in use first and second tile receiving channels are defined between the pad and the first prong, and the pad and the second prong, respectively; and a shaft tensioner between the pad and the shaft.

A combination is disclosed comprising: a tile face alignment device; a first tile positioned within the first tile receiving channel; a second tile positioned within the second tile receiving channel; and in which tension is applied to the shaft via the shaft tensioner to pull the first and second prongs toward the pad to grip the first and second tiles such that first and second external faces, of the first and second tiles, respectively, contact the pad and are flush relative to one another.

A method is disclosed comprising: inserting a base of a shaft into a gap between side walls of adjacent tiles, the base having prongs laterally extended from opposite sides of the base; positioning the prongs underlie the adjacent tiles, with a pad overlying the adjacent tiles and mounting the shaft within a passage through the pad; and applying tension to the shaft relative to the pad to draw the prongs toward the pad to grip the tiles and align external faces of the tiles flush with one another.

In various embodiments, there may be included any one or more of the following features: The pressure plate is spring mounted on the shaft. A coil spring mounted concentrically around the shaft. A handle mounted to incrementally translate along the shaft to adjust pressure on the pressure plate. The handle is threaded to the shaft. The pressure plate forms part of a spool. The spool has flanged ends spaced by a sleeve to define a finger receiving recess between the flanged ends, in which the pressure plate forms one of the flanged ends. A torque transfer connection between the pressure plate and the shaft. The torque transfer connection comprises one or more of a spline to spline connection, a keyway and key connection, and a lateral pin and axial slot connection. Each of the opposed blades has a knife edge facing one of a counter-clockwise or clockwise direction of rotation. Each of the opposed blades has a side wall facing the other of a counter-clockwise or clockwise direction of rotation. The shaft comprises first and second shafts, with one of the opposed blades extended from the first shaft and the other of the opposed blades extended from the second shaft. Side walls of the adjacent tiles contact the shaft. Before inserting, positioning the adjacent tiles on an unset mortar bed; after the adjacent tiles are clamped, withdrawing the shaft and opposed blades through the gap. Withdrawing is done after the mortar has partially set. Hooking further comprises rotating the shaft.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

There are numerous functional and aesthetic benefits to installing tiles on a wall or floor surface with consistent spacing and top faces flush between adjoining tiles. When laying tiles, or other surface cladding panels, it may be important that the tiles are laid evenly relative to the adjacent tiles. If the tiles are laid inconsistently, the finished job may be visually unsightly and may create safety concerns from tile edges and corners projecting beyond the plane of the greater surface. In addition, if sufficient spacing is not provided between adjacent tiles, the tiles may not be able to expand or contract on account of thermal or moisture changes, leading to cracking.

In order to lay tiles evenly, a tiler takes into account the space between adjacent tiles, making sure that the spaces are consistent and of uniform thickness. A common goal is to lay the external surfaces of the tiles on the same plane as far as possible, so that the matrix of tiles has the appearance of being flat and consistent. Alternatively, in the scenario where this is not possible, for example where there is fall in the floor to accommodate drainage, then the adjacent edges should as far as possible be set to the same height to avoid a "step" occurring between adjacent tiles edges. Such steps may reduce the overall visual quality of the finished job, and may possibly create a trip hazard or restrict water flow.

Tiles are typically laid manually and spaced using small disposable plastic crosses or other such spacers. While this is suitable for spacing the tiles, the issues of flatness is not addressed by such spacers. Flatness may be obtained by experience and skill, but even an experienced tiler can produce stepped tiles due to tile settling after proper positioning.

Figure 1:
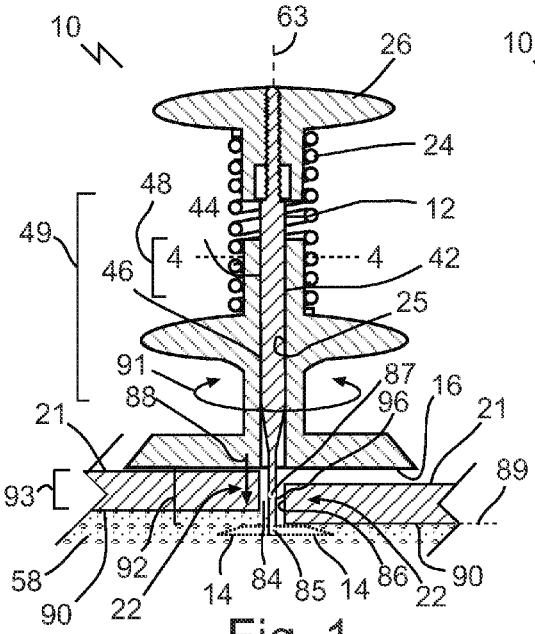
FIGS. 1-3 are a sequence of side elevation section views of a tile alignment device being positioned between adjacent tiles (FIG. 1), used to clamp the adjacent tiles (FIG. 2), and withdrawn from the tiles (FIG. 3). Dashed lines are used to show the blades (FIG. 1) and handle (FIG. 2) in different positions.
Figure 2:
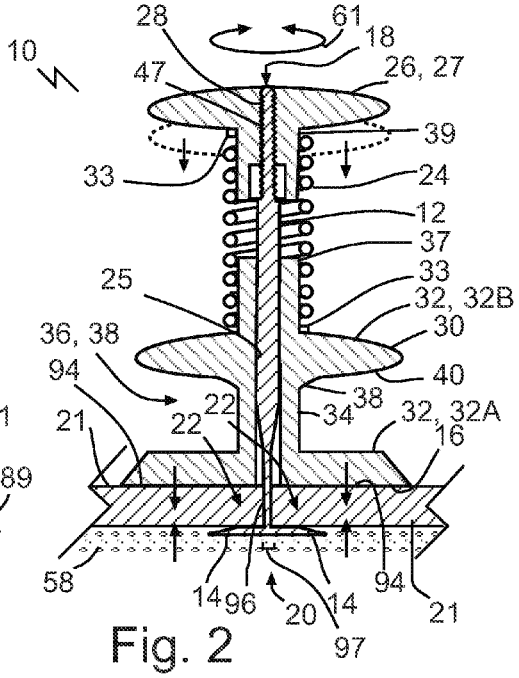

Referring to FIGS. 1 and 2, a tile alignment device 10 is illustrated, comprising a shaft 12, opposed blades 14, and a pressure plate 16. Referring to FIG. 2, shaft 12 may have a handle end 18 and a blade end 20. Shaft 12 may comprise a bolt shaft as shown. Opposed blades 14 may be extended laterally from the shaft 12 at the blade end 20. Pressure plate 16 may be mounted on the shaft 12 to define respective tile receiving recesses 22 between the pressure plate 16 and the respective opposed blades 14.

The compression plate 16 may form part of a spool 30. The spool 30 may have flanged ends 32 spaced by a sleeve 34 to define a finger receiving recess 36 between the flanged ends 32. The pressure plate 16 may form one of the flanged ends 32A as shown. A spool 30 permits finger receiving recess 36 to have an annular shape, which allows a user to insert fingers (not shown) within the recess 36 from any angle. An underside surface 40 of the upper flanged end 32B, or a transition wall 38 between the sleeve 34 and flanged end 32B, or both, may be sloped or curved to fit the naturally round sides of a user's finger (not shown).

The pressure plate 16 may be spring mounted on the shaft 12, for example using a coil spring 24 mounted concentrically around the shaft 12. The shaft 12 may be positioned to translate within an axial passage 25 through the pressure plate 16, for example between ends 32 of the spool 30. A handle 26, such as a plate 27 as shown, may be mounted to the shaft 12. The ends 33 of the spring 24 may be mounted around, on, or within respective nipple sleeves 37 and 39 located on flanged end 32 and handle 26, respectively. Other spring connection mechanisms may be used. Under normal operation a spring 24 may be selected to have a spring constant, shape, and size sufficient to retract the blades 14 against pressure plate 16 when in a neutral position and not subject to external forces from a user's hand, or a tile 21 for example. A user (not shown) may extend the blades 14 into a tile receiving or extended position (FIG. 1) by squeezing the handle 26 and spool 30 together, compressing the spring 24.

The handle 26 may be mounted to incrementally translate along the shaft 12 to adjust pressure on the pressure plate 16. One mechanism to permit incremental translation is to thread the handle 26 to the shaft 12 using a threaded connection 28. A threaded portion 47 of shaft 12 may extend to a torque transfer portion 49 of the shaft 12. A user may effectively load or unload the spring 24 by threading and unthreading, respectively, the handle 26 along the shaft 12. If the handle 26 is advanced to compress the spring 24, when the spool 30 and handle 26 are released, the increased loading on the spring 24 imparts a relatively larger clamping force between blades 14 and pressure plate 16, as discussed further elsewhere in this document. Loading the spring 24 applies controlled, positive pressure beyond that of the spring 24 in the neutral position. Other suitable mechanisms of connecting the handle 26 to the shaft 12 may be used.

The threaded portion 47 may have an outer diameter (OD) equal to or smaller than a maximum OD of torque transfer section 49, to permit the shaft 12 to be inserted axially into spool 30 from the base of the spool. An appropriate thread spacing may be selected to tailor the advancement speed of thread. For example, a standard coarse thread on a bolt may be used or adjusted to provide a faster or slower advancement per turns of handle 26. For example, a thread rate may be selected to provide a full stroke from maximum to minimum displacement with one 360 degree turn. A faster advancement rate carries a proportional increased torque requirement, so torque requirement versus advancement rate may be balanced in selecting a desired rate.

Figures 4, 4B, 4C:
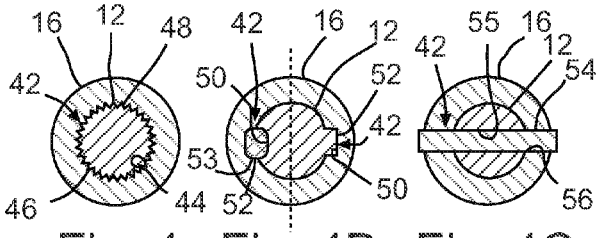
FIG. 4 is a section view taken along the 4-4 section lines in FIG. 1.
FIGS. 4B-C are section views of alternative torque transfer connections between the shaft and pressure plate. Dashed lines are used in FIG. 4B to show two different connections.

Referring to FIGS. 1 and 4, a torque transfer connection 42 may be between the pressure plate 16 and the shaft 12. The torque transfer connection 42 permits the pressure plate 16 and shaft 12 to translate axially relative to one another, while locking the two parts rotationally together. The torque transfer connection 42 shown comprises a spline to spline connection, for example a pair of mating series of splines 44 and 46, respectively, of the pressure plate 16 and shaft 12. The series of splines 44 and 46 may be contoured axially along a torque transfer portion 48 of the pressure plate 16 and a torque transfer portion 49 of the shaft 12, respectively. Referring to FIGS. 4B and 4C, other suitable torque transfer connections may be used, for example a keyway 50 and key 52 connection (FIG. 4B), and a lateral pin 54 and axial slot 56 connection (FIG. 4C). Referring to FIG. 4B, the right hand side of the dashed line illustrates a keyway 50 that may itself form a female spline mated to the key 52, which forms a male spline. The left hand side of the dashed line illustrates the key 52 as an axial pin located in keyways 50 on the shaft 12 and pressure plate 16. Referring to FIG. 4C, a lateral pin 54 may be anchored through a lateral bore 55 in the shaft 12, engaging an axial slot 56 channeled along a torque transfer portion (not shown) of the pressure plate 16.

Figure 5:
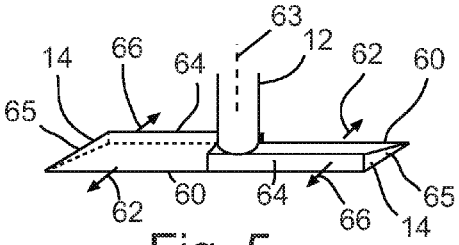
FIG. 5 is a perspective view of a blade end and blades of the shaft of the device of FIG. 1. Dashed lines are used to show the dimensions of the back of one of the blades not otherwise visible in the view.

The blades 14 may define knife edges contoured for cutting through unset or partially but not fully set mortar 58. Referring to FIG. 5, each of the opposed blades 14 may have a knife edge 60 facing one of a counter-clockwise or clockwise direction of rotation, in this case the counter-clockwise direction of rotation 62. Each of the opposed blades 14 may also have a side wall 64 facing the other of a counter-clockwise or clockwise direction of rotation, in this case the clockwise direction of rotation 66. The direction of rotations are defined from the perspective of a person looking down a shaft axis 63 from the handle end 18.

Side walls 64 and knife edge 60 may alternate as leading and trailing edges on insertion and removal of the device 10. For example, when rotating the shaft 12 clockwise to position the blades 14 under tile (not shown), as discussed further below, the side walls 64 may form the leading edge. The side walls 64 may have a face oriented perpendicular to the direction of rotation 66, thus forming a blunt object that acts to displace unset mortar and create a void (not shown) in the wake of the blades 14. When rotating the shaft 12 counter-clockwise to remove the blades 14 from under the tile (not shown), the knife edges 60 become the leading edge, passing through the void and cutting through partially set mortar that may have partially filled the void or that is present within the path of the blades 14. The arrangement of knife edges 60 and side walls 64 may be reversed for example for left-handed users, and in some cases side walls 64 are replaced with knife edges 60 or vice versa. Terminal tips 65 of each blade 14 may also form knife edges (not shown).

The components of tile alignment device 10 may be made from suitable materials. For example, plastic, steel, wood, or other materials may be used with sufficient integrity to withstand the clamping, torqueing, and spring forces exerted between components. Components may be made from different materials, for example if spool 30 and handle 26 are made of plastic and shaft 12 made of metal. If handle 26 is made of plastic, a metal thread shell (not shown) may be provided to prevent stripping of plastic threads.

Figure 3:
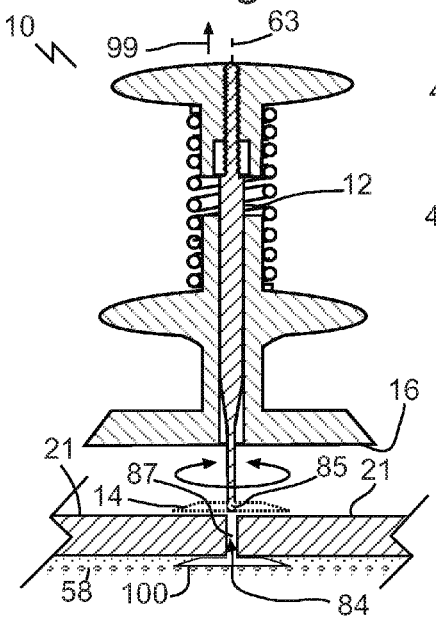

Referring to FIGS. 1-3, a method is illustrated for aligning adjacent tiles 21. A mortar bed 58 may be laid, and adjacent tiles 21 positioned on bed 58 before bed 58 has set. Referring to FIG. 1, blade end 20 and opposed blades 14 may be inserted into a gap 84 between side walls 86 of adjacent tiles 21. Prior to insertion, a user may squeeze handle 26 and spool 30 together to draw the device 10 into the extended position shown, with a separation distance 92 between the blades 14 and pressure plate 16 equal to or greater than a thickness 93 of tile 21. The stroke length of the device may be adjusted by advancing or retracting the handle 26 along the shaft 12 for thinner or thicker tiles 21, respectively.

In order to insert the blade end 20, the device 10 may be rotated to align a blade axis 85 parallel with a longitudinal axis 87 of the gap 84, and the device 10 inserted in a direction 88 along a shaft axis 63 into gap 84. Insertion may proceed until blades 14 have cleared a plane 89 defined by the underside face 90 of the lower or deeper set of the two adjacent tiles 21.

Once in position the opposed blades 14 may be hooked underneath the adjacent tiles 21. For example while in the extended position the shaft 12 may be rotated along direction lines 91 such that the blades 14 assume the position shown in dashed lines in FIG. 1, with each blade 14 underlying an underside face 90 of a respective one of the adjacent tiles 21. The use of blades 14 instead of a permanent base may reduce the thickness of the mortar bed 58 required to be used.

Referring to FIG. 2, as soon as the blades 14 underlie the tiles 21, such that each tile 21 is positioned within a respective tile receiving recess 22, the adjacent tiles 21 may be clamped between the opposed blades 14 and pressure plate 16. Clamping may be carried out by the user releasing the squeeze grip between handle 26 and spool 30, permitting spring 24 to draw blades 14 towards pressure plate 16, hooking the tiles 21 and drawing external faces 94 into contact with pressure plate 16 and flush relation with one another. While in the clamped position shown, the spring 24 applies constant tension on shaft 12 and pressure upon pressure plate 16, maintaining the grip upon the tiles 21. In some cases, additional force may be needed to align the tiles 21, for example when using relatively large or heavy tiles. In such cases, the handle 26 may be incrementally translated to increase spring loading. For example the handle 26 may be rotated along direction lines 61 to thread the handle 26 further down the shaft 12 to the position shown in dashed lines, compressing and loading the spring 24 until tiles 21 are aligned. Downward pressure from a user, for example a user's palm, against plate 27 may assist translation by reducing the torque required to perform the translation. During translation of the handle plate 27 the pressure plate 16 may be rotationally isolated from the handle plate 27. Thus, the pressure pad 16 may remain rotationally stationary relative to the handle 26, avoiding imparting torque on the tiles 21, of which such torque may act to reposition the tiles 21 undesirably.

The shaft 12 may be provided with a tile contacting portion 96 that has a width 97 equal to a desired gap spacing between adjacent tiles 21. Common spacing widths include ⅛ and ¼ of an inch for example. Once the device 10 is in the clamped position, or before clamping but while shaft 12 is inserted within the gap 84, the position of tiles 21 may be adjusted to contact shaft 12 with side walls 86. For example, a rubber mallet (not shown) may be tapped against an opposing side wall (not shown) to translate one tile 21 toward the other to close the gap 84. Thus, the shaft 12 may act as a spacer in addition to an alignment device. Tile contacting portion 96 may comprise a relatively narrow stem extended from torque transfer portion 49 of shaft 12.

Referring to FIG. 3, at some point after the adjacent tiles 21 are clamped, the device 10 is removed from between the tiles 21. In some cases withdrawing is done after the mortar 58 has partially set but before full setting has occurred. In one case the mortar 58 has set sufficiently if a user is able to walk on the tiles 21 without disturbing the tile 21 positioning. Removal may be done by withdrawing the shaft 12 and opposed blades 14 through the gap 84. As part of removing the device 10, the shaft 12 may first be rotated to once again align the blade axis 85 parallel with a longitudinal axis 87 of the gap 84. Knife edges 60 (FIG. 5) if present may cut through mortar present along the rotational path of the blades 14 during rotation. Once aligned, withdrawal may be completed by pulling blade end 20 out of gap 84 along a direction 99 parallel to the shaft axis 63. Thus, the entire device 10 may be removed leaving no parts remaining in the mortar 58. Because the entire device 10 may be removed, the entire device 10 may then be reused on a subsequent job. A gap 100 may be left behind in mortar 58 at the position where blades 14 were formerly located. Subsequently grout or other gap filling material may be inserted into tile gaps 84, filling the gap 100 and filing the space between the side walls 64 of the tiles 21.

Figure 6:
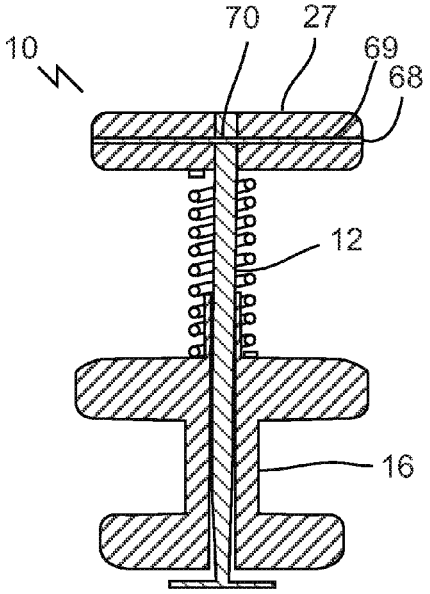
FIG. 6 is a further embodiment of a tile alignment device.
Figure 7:
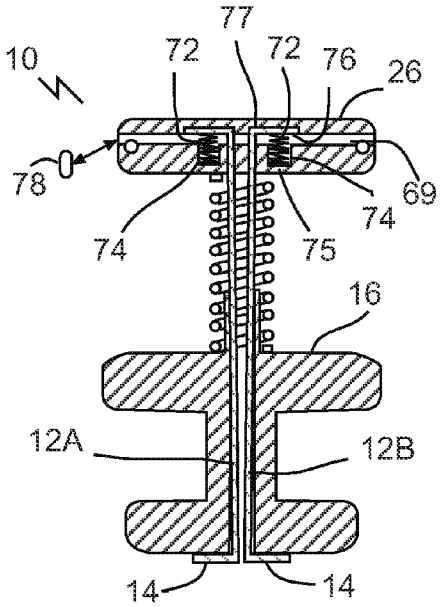
FIG. 7 is a further embodiment of a tile alignment device with dual shafts.
Figure 8:
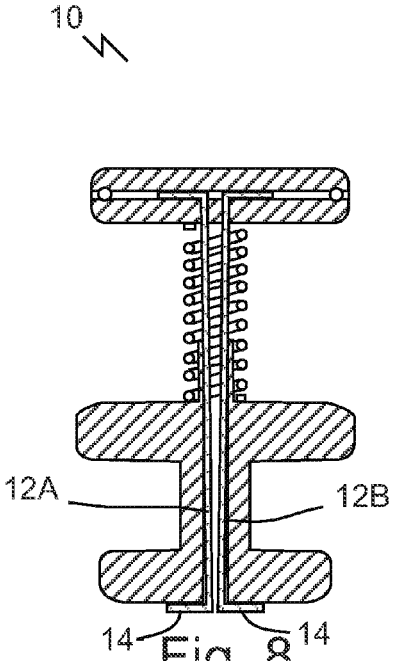
FIG. 8 is a further embodiment of a tile alignment device with dual shafts, and respective springs for each shaft.
Figure 9:
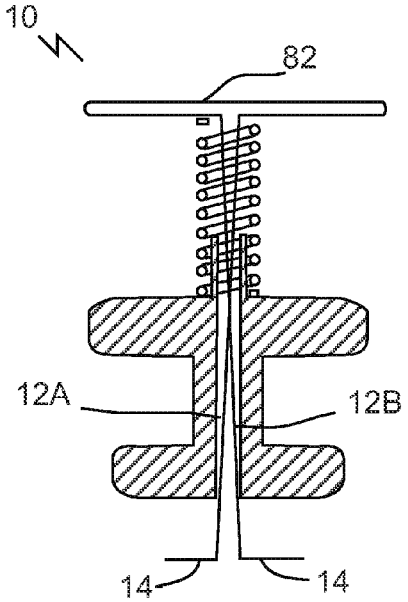
FIG. 9 is a further embodiment of a tile alignment device with dual shafts formed of a single bent wire.

Referring to FIGS. 6-9, further embodiments of a tile aligning device 10 are illustrated. In the examples shown, no torque transfer connection 42 is used, although one may be used. Without a torque transfer connection the shaft 12 may be rotated relative to the pressure plate 16. Referring to FIG. 6, the handle plate 27 is secured to the shaft 12 via a lateral pin 68 passing through aligned lateral bores 69 and 70 in the handle plate 27 and shaft 12, respectively. The handle plate 27 may form a palm grip. Referring to FIGS. 7-9, the shaft 12 may comprise first and second shafts 12A and 12B, with one of the opposed blades 14 extended from the first shaft 12A and the other of the opposed blades 14 extended from the second shaft 12B. Providing each blade 14 on its own shaft 12 permits use of device 10 with tiles (not shown) of varying thicknesses, such as slate. Referring to FIG. 7, each shaft 12A, 12B may be spring mounted to pressure plate 16, for example by spring mounting via respective springs 72 to handle 26, which itself is spring mounted to pressure plate 16. Respective springs 72 may be positioned in respective recesses 74 within handle 26, between opposed shoulders 75, 76 of the handle 26 and shaft 12A, 12B. Shoulders 76 of shafts 12A, 12B, may be formed by a bent end 77 of the shafts 12A, 12B, such bent end 77 retained within a lateral bore or slot 69 in handle 26. A cap plug 78 may be used to seal the ends of handle 26. Referring to FIG. 8, a similar version of FIG. 7 is illustrated without springs 72. Referring to FIG. 9, an example is shown where the shaft 12 is formed by a single piece of bent wire 82.

The device 10 may be withdrawn before mortar has set. A portion of the shaft 12 or blades 14 may be left behind in the mortar, for example if the mortar sets and the blades 14 cannot be dislodged. For such a case a break point or other disconnection mechanism may be provided to permit separation of the device at a point below a plane defined by the flush external faces 94 of the adjacent tiles 21. The tiles 21 may be levelled in addition to being made flush with one another. More than two blades, tines, fingers, or prongs 14 may be provided, for example if four blades are provided in a cross configuration for hooking the undersides of the corners of four adjacent tiles. Three or more blades are possible for other tile configurations.

Squeezing of handle 26 together with spool 30 is described above to put the device 10 into the extended position, but other methods may accomplish extension, for example lateral force in some designs may extend the hook. A coil spring 24 is described but other springs may be used, including leaf springs, bows, butterfly spring, a biasing device, and other elastic objects used to store mechanical potential energy. A motor may be used to extend or retract the blade end 20. Incremental translation or advancement may be achieved using suitable mechanisms such as cranks, pulleys, chain and sprocket, ratchets, wedges, endless conveyors, and other force transfer devices. Devices 10 may be connected between adjacent tiles before positioning the tiles on a mortar bed 58.

Other suitable mechanisms may be used to connect the handle 26 to the shaft 12, such as friction fit, welding, and others. A shaft tensioner may be provided between shaft 12 and pressure plate 16, similar to a bolt tensioner. Passage 25 may extend part way into pressure plate 16. Passage 25 may comprise a slot in pressure plate 16. Up, down, top, base, and other relative words are not intended to be limited to absolute dimensions defined with respect to the direction of gravitational acceleration on the earth. In some cases the tiles 21 may be located on a wall, ceiling, or other non-horizontal surface.

Description of a component being located at an end includes locating the component at or near the end. The blades 14 may have a suitable propeller shape for cutting through and displacing mortar. Device 10 may be used in suitable applications such as tiling or paving applications. Mortar comprises a workable paste used to bind building components together, and includes adhesive, thinset, concrete, grout and other cementitious compositions. A screwdriver connection may be provided to translate the pressure plate 16 or handle 26 to clamp the tiles 21 together. In some cases no spring is provided, for example if spring 24 is removed from the embodiment of FIG. 1, and the handle 26 incrementally translated to clamp the tiles 21 between pressure plate 16 and blades 14. A bushing surface (not shown) may be provided between the necks 37 and 39 to prevent handle 26 and spool 30 from rotationally locking via friction.

Blades 14 may extend along a common blade axis 85 or may have parallel but relatively displaced axes, in case the position of each blade 14 is different to compensate for different tile thicknesses. Blades 14 may be non-linear in shape, such as if blades 14 are curved upward and resilient to accommodate different tile thicknesses. Pressure plate 16 may have a tile contacting surface, for example comprising resilient or flexible material such as rubber or foam. The tile contacting surface may have a planar surface. The blades 14 and base end 20 may form a three dimensional T-shape. A width of the blade end 20 along an axis perpendicular to the shaft axis 63 and the blade axis 85 may be equal to or less than a width of tile contacting portion 96. Plates 16 and 27 may be disc-shaped. A cross section of the shaft 12 perpendicular to the shaft axis 63 across the torque transfer portion 49 may have a polygonal shape. The blades 14 may be integrally connected with the base end 20. Blades 14 may have lateral passages, slots or apertures, to permit the passage of mortar during rotation. The shaft 12 may have a circular, square, or other suitable shape in cross section.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The invention claimed is:

1. A method comprising:

positioning adjacent tiles on a mortar bed that is unset;

while the mortar bed is unset, inserting a blade end of a shaft into a gap between side walls of the adjacent tiles, the blade end having opposed blades extended laterally from the shaft;

hooking the opposed blades underneath the adjacent tiles;

clamping the adjacent tiles between the opposed blades and a pressure plate mounted by a spring to the shaft, in which the spring applies pressure between the pressure plate and the opposed blades to push the pressure plate against the adjacent tiles to cause alignment; and after the mortar bed is partially set, withdrawing the shaft and the opposed blades through the gap.

2. The method of claim 1 in which hooking further comprises rotating the shaft.

3. The method of claim 1 in which the spring further comprises a coil spring mounted concentrically around the shaft.

4. The method of claim 1 in which clamping further comprises translating a handle along the shaft to compress the spring to push the pressure plate against the adjacent tiles to cause alignment.

5. The method of claim 4 in which the handle is threaded to the shaft.

6. The method of claim 1 in which the pressure plate forms part of a spool.

7. The method of claim 6 in which the spool has flanged ends spaced by a sleeve to define a finger receiving recess between the flanged ends, in which the pressure plate forms one of the flanged ends.

8. The method of claim 1 further comprising a torque transfer connection between the pressure plate and the shaft.

9. The method of claim 8 in which the torque transfer connection comprises one or more of a spline to spline connection, a keyway and key connection, and a lateral pin and axial slot connection.

10. The method of claim 1 in which each of the opposed blades has a knife edge facing one of a counter-clockwise or clockwise direction of rotation.

11. The method of claim 10 in which each of the opposed blades has a side wall facing the other of a counter-clockwise or clockwise direction of rotation.

12. The method of claim 1 in which the shaft comprises first and second shafts, with one of the opposed blades extended from the first shaft and the other of the opposed blades extended from the second shaft.

13. A method comprising:

positioning adjacent tiles on a mortar bed that is unset;

while the mortar bed is unset, inserting a blade end of a shaft into a gap between side walls of the adjacent tiles, the blade end having opposed blades extended laterally from the shaft;

hooking the opposed blades underneath the adjacent tiles;

clamping the adjacent tiles between the opposed blades and a pressure plate mounted on the shaft, in which the pressure plate forms part of a spool, and the spool has flanged ends spaced by a sleeve to define a finger receiving recess between the flanged ends, in which the pressure plate forms one of the flanged ends; and after the mortar bed is partially set, withdrawing the shaft and the opposed blades through the gap.

14. The method of claim 13 in which hooking further comprises rotating the shaft.

15. The method of claim 13 in which the pressure plate is mounted by a spring to the shaft, in which during clamping the spring applies pressure between the pressure plate and the opposed blades to push the pressure plate against the adjacent tiles to cause alignment.

16. The method of claim 15 in which the spring comprises a coil spring mounted concentrically around the shaft.

17. The method of claim 15 in which clamping further comprises translating a handle along the shaft to compress the spring to push the pressure plate against the adjacent tiles to cause alignment.

18. The method of claim 17 in which the handle is threaded to the shaft.

19. The method of claim 13 further comprising a torque transfer connection between the pressure plate and the shaft.

20. A method comprising:

positioning adjacent tiles on a mortar bed that is unset;

while the mortar bed is unset, inserting a blade end of a shaft into a gap between side walls of the adjacent tiles, the blade end having opposed blades extended laterally from the shaft;

hooking the opposed blades underneath the adjacent tiles;

clamping the adjacent tiles between the opposed blades and a pressure plate, the pressure plate being mounted by a spring to the shaft, in which clamping further comprises translating a handle along the shaft to compress the spring to push the pressure plate against the adjacent tiles to cause alignment; and after the mortar bed is partially set, withdrawing the shaft and the opposed blades through the gap.

* * * * *